United States Patent [19]

Vittone et al.

[11] Patent Number: 4,594,210

[45] Date of Patent: Jun. 10, 1986

[54] PROCESS FOR MANUFACTURING CEMENT PLATES REINFORCED WITH FIBRILLATED POLYMERIC FILMS

[75] Inventors: Andrea Vittone, Milan; Giuseppe Chiappini, Albiano Magra; Massimo Di Paola, Rapallo, all of Italy

[73] Assignee: Moplefan S.p.A., Milan, Italy

[21] Appl. No.: 571,718

[22] Filed: Jan. 18, 1984

[30] Foreign Application Priority Data

Jan. 18, 1983 [IT] Italy ..... 19149 A/83

[51] Int. Cl.[4] ..... B28B 23/00

[52] U.S. Cl. ..... 264/70; 264/87; 264/136; 264/145; 264/160; 264/257; 264/333; 264/510

[58] Field of Search ..... 264/69, 70, 87, 101, 264/136, 137, 160, 257, DIG. 57, 333, 510, 145

[56] References Cited

U.S. PATENT DOCUMENTS 4,267,136 5/1981 Bijen ..... 264/257

FOREIGN PATENT DOCUMENTS 0003245 12/1978 European Pat. Off. .
0021362 1/1981 European Pat. Off. ..... 264/257
2356610 6/1977 France .
1582945 6/1977 United Kingdom .
2003422 8/1978 United Kingdom .
2041816 11/1978 United Kingdom .
2038701 11/1979 United Kingdom .

*Primary Examiner*—Jan Silbaugh
*Assistant Examiner*—Hubert C. Lorin
*Attorney, Agent, or Firm*—Stevens, Davis, Miller & Mosher

[57] ABSTRACT

A process is provided for continuously manufacturing plates containing an open net fibrillated polymeric film reinforcement. A net having a plurality of fibrillated polymeric film layers is unwound from a continuous reel, and the net is cut into pieces having a length approximately equal to a circumference of a forming roll for forming a plate to be manufactured. The net pieces are impregnated with a cement mix and then deposited onto a conveyor belt on which a cement mix layer has been previously deposited. After contacting the net with the cement layer, the net is subjected to vibration. A vacuum is applied to the net contacting the cement layer to remove excess water and to increase the compactness between the net and the cement layer. The net-cement panel resulting from the above is wound onto the forming roll, which has a circumference approximately equal to the length of the net piece, with simultaneous application of pressure, so that the ends of the net piece are disposed adjacent to a notch located at a periphery of the forming roll. The net-cement panel is cut at the notch adjacent to which the ends of the net pieces are arranged to form a plate, and finally the plate is compressed.

4 Claims, 1 Drawing Figure

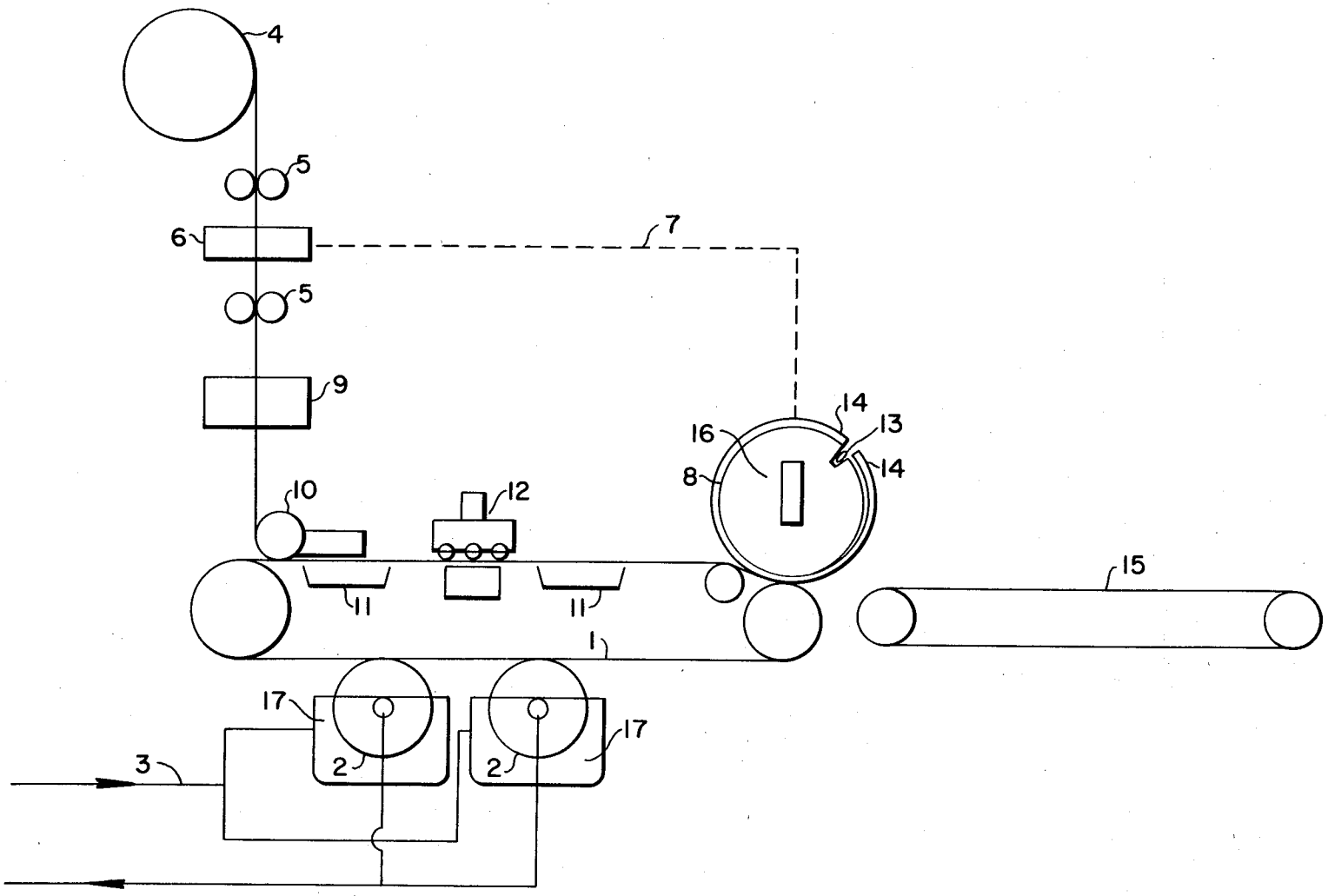
4
5
6
7
5
9
10
11
12
11
1
13
14
14
16
8
15
17
2
2
17
3

PROCESS FOR MANUFACTURING CEMENT PLATES REINFORCED WITH FIBRILLATED POLYMERIC FILMS

THE PRIOR ART

From British patent No. 1,582,945 it is known that it is possible to obtain cement plates endowed with improved mechanical characteristics by incorporating thereinto net-like open fibrillated polymeric films instead of the known fillers based on asbestos fibres.

European patent publication No. 21,362, British applications Nos. 2,038,701 and 2,041,816 and Dutch application No. 77 14 571 disclose further methods of preparing such articles on a commercial sale.

The processes described therein, though with different devices, have in common the principle of comprising the simultaneous impregnation of a certain number of multilayer fibrillated nets, and successively their superposition, in order to attain the desired ratio by volume between film and final product, generally ranging from 2% to 10% and more particularly from 5% to 8%.

Such methods, however, exhibit several drawbacks, the most important of which are:

- difficult impregnation of the nets; in fact with a view to limiting the number of net reels simultaneously fed, for reasons of plant simplicity, it is necessary to utilize multilayer nets;
- conversely, it is possible to have plant complications and additional operating costs with machines having a great number of positions for the simultaneous feeding and impregnation of nets;
- difficult extraction of the water in excess due to the thickness of the monolithic net-and-cement panel, which may limit the production rate, Thus, it is of interest to provide processes which utilize only one multilayer net, associating it with thin layers of cement mixes, and which therefore permit a higher removal rate of the water in excess and by consequence a higher feeding rate of the net and, finally, provide plate production rates approximately equal to those at which the various nets are contemporaneously impregnated.

A process for producing cement plates which consists in form thin mix layers on a porous belt, in rapidly removing the water in excess therefrom and in superposing and winding them upon a roller—which is called forming roller—from which, by means of a horizontal cutting, a plate is obtained, is a technique long known both in the manufacture of cardboards and of asbestos-cement plates, where it is referred to as a Hatscheck process or machine. Wide references to such process are to be gound e.g. in "Asbestzement" by Harold Klos, 1967, Springer Verlag, and in "Technical Report No. 1 (51.067)"—July 1973, 18-19.

In such process, the layer of asbestos/cement mix is deposited onto the porous strip by means of rotary filters which plunge into tubs or tanks fed by dilute asbestos/cement suspensions.

A process of manufacturing cement plate or plates of hydraulic binders reinforced with fibrillated polymeric nets, which is based, for the production of the plate, on the known principle of the forming roller already existing in the Hatscheck process is described in British patent application No. 2,003,422.

According to this process, it is envisaged to bind a single multilayer net to a thin layer of cement mix which has been previously deposited according to known techniques onto a porous strip (for example by spraying, or rolling, or filtration according to the Hatscheck method), to remove the water in excess by means of vacuum, and then to wind up the impregnated layers on a roll put under pressure, where the layers reciprocally unite and compact till reaching the desired thickness.

Such process, however, is affected by the serious drawback of allowing the cutting of the wound up plate, along with the cutting of the net coming from the conveying belt, only in one point, i.e. in the point of contact between the forming roll and the underlying roll. This involves stopping the machine and lifting the forming roll, this being a very complicated step requiring the standstill of the machine during a certain time period for each plate, such time period being sometimes even longer than the forming time.

THE PRESENT INVENTION

The process forming the object of the present invention utilizes too the known principle of winding up the plate on the forming roll already utilized in the Hatscheck machines, but it is practiced in a series of steps which overcome the above-noted drawbacks of the various processes and in particular the ones cited with reference to British application No. 2,003,422.

The process is also employable—by plant adaptations and integrations—in the existing Hatscheck machines for the asbestos-cement plates, which constitute most of the production of the specific field.

The process which is the object of this invention comprises, in order, the following operative steps:

(a) unwinding one or more nets, each composed of a plurality of layers of fibrillated polymeric film, in an open form, from continuous reels;

(b) cutting such net into pieces having a length approximately equal to the circumference of the forming roll, or a length equal to the length of the entire net wound up by the roll for each plate;

(c) causing the net pieces to be impregnated by a cement mix optionally containing one or more wetting agents;

(d) depositing the net pieces onto a porous conveying belt on which there was previously deposited a cement mix layer containing from 15 to 100, but preferably from 20 to 50 parts of water, referred to 100 parts of solids, having a thickness at least equal to, but preferably ranging from 1 to 4 times that of the net;

(e) exerting vertical percussion and vibration actions on the net when it has come into contact with the cement layer;

(f) creating vacuum to remove the water in excess and to increase the compactedness degree between net and cement;

(g) winding up the net-cement panel on a roll having a circumference equal to the length of the plate to be obtained, and simultaneously applying pressure, orientatively from 5 to 80 kg/linear cm, but preferably from 20 to 50 kg/linear cm;

(h) cutting the plate at the notch around which the ends of the net pieces are arranged; and (i) compression of the plate so cut.

The process herein described permits use of the conventional and known Hatscheck machines for preparing asbestos-cement plates, and in general all the machines operating by means of porous belts, always for treating the asbestos-cement, which collect the plate on a forming roll, by not substantially modifying the machine and without requiring reductions in productivity and regular stops.

This process also permits working with substrates containing other fibrous materials, since the impregnation of individual nets on thin layers is very effective, provided the above-mentioned process features are observed and provided a ratio higher than 1 or equal to 1 between the thickness of the cement mix elementar layer and the rated thickness of the multilayer net is observed.

The products obtained are therefore cement plates, or cement-asebestos plates, or plates of cement with other organic and inorganic fibrous materials, in which the net acts as a reinforcement, imparting to the obtained plate high characteristics of pseudoductility to flexure and high impact strength of the order of 200 times the impact strength of asbestos-cement.

Precutting step (b) and step (c) of impregnating with cement mix may also be inverted in the order; as well as steps (e) and (f) of percussion or vibration, and of vacuum, respectively.

The cement mix thicknesses on the conveying belt according to step (d) can be usually produced in the Hatscheck-type machines if the cement is combined with a filtering material which permits the cement to deposit onto the filtering rolls, such as for example various types of asbestos, fibrids and/or polyolefinic fibres, cellulose, paper pulp, organic and inorganic fibres, colloidal clays, etc., according to conventional techniques.

As an alternative, such tin cement mix layer can be deposited in other ways, for example by rolling and spraying, according to processes other than the Hatscheck process. Preferably the cement mix thickness is less than 3 mm, and more particularly it ranges from 0.1 to 1.5 mm.

As already mentioned hereinabove, cutting of the nets into pieces, according to step (b), can be accomplished conforming to two different modalities:

cutting into pieces having a length approximately equal to the circumference of the forming roll and arrangement of the end of the pieces at the edges of the slot of the roll in which there is placed the blade for removing and detaching the plate; such predetermined arrangement is accomplished by means of an operative connection roll rotation and cutting device (which is present in fact in the forming roll of the Hatscheck machine) and serves to avoid the necessity of directly cutting on the roll the plate containing the fibrillated net, thus avoiding both plant complications and the necessity of stopping or slaking the roll rotation to permit the cutting; the removal blade is not hindered by the net and therefore acts on the wet cement matrix at the slot, operating in the same manner as it is used in the production of asbestos-cement in the Hatscheck machines. The term "approximately equal" as used hereinbefore means that the net pieces must have a length somewhat less than the roll circumference, in order to let the slot free;

cutting of pieces having a length equal to the length of the whole net wound up by the roll for each plate; the cutting of the net serves in this case to avoid the drawbacks affecting the methods used so far, and in such case the plate must be cut by means of suitable devices—for example bad blades, saws, pressurized water jets, and the like—arranged inside or outside the forming roll.

The impregnation of the net or the multiplicity of nets with the cement mix according to step (c) has also the aim of eliminating the air from the net, as well as of introducing in the net products which facilitate the impregnation of the net by the cement mix and the adhesion to each other.

Such products can be represented by conventional wetting agents, as well as by known fluidifying agents for the cement, such as "Tween 20" (condensation product of ethylene oxide with fatty acids, produced by Soc. Atlas), or "Melment L" (anionic melamine-formaldehyde resin produced by S.K.W.), and further by salt solutions and precipitating or flocculating agents, which cause the metal salts or hydroxides (such as Ca or Al silicates or hydroxides) to deposit on the net, so as to improve the adhesion of the net to the cement.

Said impregnation can be carried out by immersion or spraying methods, or by contacting the net with impregnating rollers, or also by pouring the cement mix either over or under the net, as the net comes into contact with the cement layer carried by the porous belt.

The cement suspensions suited for impregnating the net have generally a water contact between 25% and 500%, but preferably between 40% and 100% by weight on the dry cement weight.

The impregnation treatment (c) can be preceded by a separate treatment with wetting and/or flocculating agents.

Passing of the net through an aqueous solution or suspension of a wetting agent, has mainly the purpose of removing the air contained on the net, and secondarily, while operating in the presence of particular substances combined with the surfactant, the purpose of depositing onto the net products capable of influencing both the impregnation process with the hydraulic binder and the successive characteristics of the finished plates.

Such products may be, besides the common surfactants and surface-active agents, the above mentioned cement fluidizing agents, or also dilute cement suspensions, which in this case are recycled by the plate-forming machine, which suspensions, besides removing the air from the net, already deposit thereonto cement granules. An operative net deaerating step can be in any case introduced and effected separately, with different liquid media or other known methods.

It has been furthermore surprisingly found that the net, so wet and deaerated, beside being very easy and quick to impregnate, exhibits also a higher easiness of handling and a higher cohesion which facilitates the deposition steps onto the porous belt. Such cohesion can be additionally enhanced by adding to the solutions or suspensions cohesion-promoting agents, such as polyvinyl alcohol, dextrin, starch, aqueous suspensions of acrylic glues, etc.

Plate compression step (i) generally involves the extraction of the cut plate from the forming roll, the deposition thereof onto a flat mold or onto a mold having any desired profile, and the compression thereof, with pressure values generally ranging from 10 to 70 kg/cm$^2$, and preferably from 20 to 60 kg/cm$^2$. Such compression, which can be carried out also by means of trains of pressing rolls or by means of pressing plates, aims at flattening the reinforcement-containing plate, which otherwise would tend to slightly bend.

The following variants may be furthermore brought to the process described hereinabove:

(1) the composition of the plate by means of subsequent layers of net and cement matrix may occur according to different modalities controlled by the net cutting times; that enables plates to be obtained, which have layers free from net and layers containing reinforcing fibrillated net in the plate itself.

The reason therefor may be for example the object of a better coating of the outer layers by the matrix, or the object of not utilizing the reinforcing net at the neutral axis of the plane plate.

(2) The net, instead of consisting of a continuous body over the entire width of the plate, may consist of a compound of narrower nets, which move together in parallel fashion like strips and are arranged in such a way as to reinforce certain areas of the plate.

This may be useful in particular in the case of corrugated plates, in which the reticular reinforcement is mostly effective in the lower area of the corrugations.

The annexed figure schematically shows the various steps of the process carried out by using a Hatscheck-type machine, in which the cement elementary layer is obtained by filtration, such process however being applicable to machines equipped with a forming roll which produces the elementary layer with other means.

In such figure, (1) indicates the porous belt into which filtering rolls (2), plunging into a like number of tubs or tanks (17) containing the cement suspension, deposit the elementary cement layer from the suspension fed by (3). (4) indicates the reel of polymeric film fibrillated net, and (5) indicates the devices for grasping and feeding the net which is periodically cut into pieces in the cutting device (6), through the operative connection (7) with the forming roll (8), on which pressure (16) acts.

(9) indicates an immersion or spraying device from which the net in pieces is soaked, deprived of air and preliminarily impregnated, while (10) indicates a device for accompanying and depositing the net pieces onto the elementary cement layer deposited and conveyed by belt (1).

(11) indicates vacuum boxes to reduce the water content and (12) indicates a percussion and vibration device which compacts the net and the cement mix with each other. (13) indicates the notch on forming roll (8) where the plate cutting and expulsion blade is placed, while (14) indicates the pieces' ends, having a length approximately equal to the circumference of the forming roll and placed at the edges of the notch, in order not to contrast the movement of the detaching blade.

The operative connection (7) may consist for example of proximity magnetic switches, placed on the forming roll, which control, through an electric circuit, the film cutting device.

It serves to provide synchronization between the peripheral winding speed of the plate on the forming roll and the cutting device, so that the net piece ends may arrange around the cutting slot in order not to hinder the action of the cutting blade which acts only on the moist cement matrix.

The plate detached and expelled from the roll (8) is collected by belt (15), then it is subjected to compression step (i) on devices not shown on the drawing, and is successively sent to the usual rim trimming, corrugation, curing, painting operations, etc.

The thus obtained plate is formed by layers of hydraulic binder coming from the filtering boxes, and by layers of hydraulic binder coming from the impregnation step, in particular the ones laid down correspondingly with the deposition of the net. The layers coming from the filtering boxes can have a different composition with respect to the layers coming from the impregnation step. For instance, if a Hatscheck-type machine is used, the layers coming from the filtering boxes may contain asbestos and/or cellulose fibres, and/or synthetic polymer fibrids, or other materials suited for aiding the deposition of cement onto the filtering rollers, whereas the layers coming from the impregnation step (or from other outer feeding) which contain the fibrilled nets may contain cement only, as the fibrilled net exerts by itself the function of mechanical reinforcement.

Moreover, the filtered layers, which also form the outer layers of the end plate, may contain colouring matters and/or modifiers for the surface of the plate, whereas the layers coming from the outer feeding may contain lightening agents such as pumice powder.

The following examples are given to illustrate the present invention, without limiting it.

EXAMPLE 1

A 2-tank Hatscheck type machine was fed with a mix consisting of 7.5 parts by weight of Italian asbestos (Balangero) of degree 4 and 5 respectively in a ratio by weight of 1:1, of 100 parts of Portland cement and of 1100 parts by weight of water.

Asbestos had been previously subjected to the usual opening treatment in a blade mill.

The machine was suited to produce with such mix flat plates, having a thickness of 6.0 mm, of asbestos/cement by 12 revolutions of the forming roll, which has a diameter of 83 cm. The thickness of the cement mix on the conveyor belt was of about 0.5 mm.

The machine was fed, by means of the device indicated in FIG. 1, with a polypropylene fibrillated net, composed of 4 layers, each layer having a thickness of 0.070 mm, and having a specific volume of 32 $cm^3/m^2$.

The plate production modalities were the following:

1st revolution of the winding up roll, without net;

from the 2nd to the 11th revolution, with the net;

12th revolution, without net.

During the process, the net was wetted by passing through a roll-equipped apparatus with waste water flowing from the filtering rollers and containing traces of suspended fine particles of cement, and it was cut into 250 cm long pieces.

Subsequently, the net was impregnated by a cement mix consisting by weight, of 1000 parts Portland cement 1 part Melment, 60 parts water.

Said cement mix was applied by a batching plant which sprayed the mix onto the net pieces.

The whole amount of the sprayed mix was 5 liter per meter of the plate width and per meter of passage of the porous belt.

The plate was wound up on the roll with a pressure of 35 kg/linear cm for a thickness of 7.2 mm, and contained about 320 $cm^3/cm^2$ of fibrillated net with a volume of 4.4% of net referred to the plate volume.

On quantitative analysis after extraction from the forming roll, compression in a plate press under a pressure of 40 $kg/cm^2$, curing in water during 28 days and drying at 100° C., the resulting plate was composed as follows:

cement, parts by weight: 100
asbestos, parts by weight: 7.5
fibrillated net, parts by weight: 2.1

The 4-point bending test on Instrom dynamometer and on 15×5 cm specimens gave the following results:

check plate, thickness=6 mm, asbestos/cement:
catastropic break with detachment of the parts from one another, with $\sigma$ value (modulus of breaking to flexure)=162 kg/cm$^2$ plate with PP fibrillated net, thickness=7.2 mm:
pseudoductile breaking with formation of cracks, noncatastrophic and without detaching of the parts from one another:
$\sigma$ value at the first crack=173 kg/cm$^2$
$\sigma$ value at the final load=248 kg/cm$^2$
distance between the cracks=1.6 mm.

EXAMPLE 2

A Hatscheck-type machine like that of example 1 was fed with a mix composed of 2.5 parts by weight of polyethylene fibrids (Ferlosa produced by Montedison) having a specific surface of 5 m$^2$/g, of 100 parts by weight of Portland cement and of 1000 parts by weight of water.

The fibrids had been previously opened by wet treatment in a blade mill.

The machine was fed with polypropylene fibrillated film nets composed of 4 layers having a specific volume of 30 cm$^3$/m$^2$, the elementary film thickness being of 0.060 mm. The machine so fed was capable of producing a plate having a thickness from 6.5 to 6.7 mm by means of 16 revolutions of the forming roll, which had a diameter of 83 cm and on which a pressure of 30 kg/linear cm was exerted. The thickness of the cement mix elementary layer on the belt was of about 0.4 mm. The net was cut into 250 cm long pieces and the application thereof was effected during 14 revolutions per plate, namely with exception of the two plate ends, the first and the last.

The cut plates, after extraction from the forming roll, were compressed in a plate press employing a 40 kg/cm$^2$ pressure.

The plates so obtained, having a thickness ranging from 6.5 to 6.7 mm, contained on the average 420 cm$^3$/m$^2$ of fibrillated net, corresponding to a volume of 6.4%.

The 4-point bending test on Instrom dynamometer and on 15×5 specimens gave as a result a pseudoductile breaking, with formation of cracks, non-catastrophic and without detaching of the parts from one another:
$\sigma$ value at the first crack=145 kg/cm$^2$
$\sigma$ value on final load=352 kg/cm$^2$
distance between the cracks=1.0 mm.

What I claim is:

1. A process for continuously manufacturing plates containing an incorporated reinforcement including a fibrillated polymeric film comprising an open net, which comprises the following steps:

(a) unwinding at least one net comprising a plurality of fibrillated polymeric film layers, in an open form, from at least one continuous reel,
(b) cutting said net into pieces having a length approximately equal to a circumference of a forming roll for forming a said plate to be manufactured,
(c) impregnating the net pieces with a cement mix,
(d) depositing the net pieces onto a conveyor belt on which a cement mix layer has been previously deposited, said cement mix layer containing from 15 to 100 parts by weight of water referred to 100 parts by weight of solids and having a thickness at least equal to that of said net,
(e) subjecting the net after it has come into contact with the cement mix layer to percussion and vertical vibration actions,
(f) applying a vacuum to said net contacting said cement layer to remove excess water and to increase a degree of compactness between said net and cement of said cement layer,
(g) winding a net-cement panel resulting from step (f) onto a said forming roll having a circumference approximately equal to a length of a said net piece, and simultaneously applying pressure to said net-cement panel during said winding step, so that ends of said net piece are disposed adjacent to a notch located at a periphery of said forming roll,
(h) cutting a said plate to be manufactured at the notch adjacent to which the ends of the net pieces are arranged without stopping rotation of said forming roll, and
(i) compressing the plate cut in step (h).

2. The process according to claim 1, in which the cement mix layer contains from 20 to 50 parts by weight of water referred to 100 parts by weight of solids.

3. The process according to claim 1, in which the cement mix layer ranges from 1 to 4 times the thickness of the net.

4. The process according to claim 1, in which the pressure applied to said forming roll, in step (g) ranges from 20 to 50 kg/linear cm.

* * * * *